US005816301A

United States Patent [19]

Stager

[11] Patent Number: 5,816,301

[45] Date of Patent: Oct. 6, 1998

[54] KNIFE SUPPORTING STRUCTURE

[75] Inventor: Brad R. Stager, Beaverton, Oreg.

[73] Assignee: Key Knife, Inc., Portland, Oreg.

[21] Appl. No.: 54,307

[22] Filed: Apr. 2, 1998

Related U.S. Application Data

[63] Continuation-in-part of Ser. No. 904,968, Jul. 30, 1997.

[51] Int. Cl.[6] ..... B27G 13/04

[52] U.S. Cl. ..... 144/228; 83/698.14; 144/220; 407/46; 407/101

[58] Field of Search ..... 144/218, 220, 144/228, 229, 231, 241; 407/37, 40, 46, 87, 95, 101, 107; 83/698.11, 698.41

[56] References Cited

U.S. PATENT DOCUMENTS 743,374 11/1903 Bresman .
972,479 10/1910 Sondergard .
1,405,614 2/1922 Mitchell .
5,271,442 12/1993 Carpenter et al. .
5,395,063 3/1995 Schrodl .
5,511,597 4/1996 Shantie et al. .
5,709,255 1/1998 Toogood .

*Primary Examiner*—W. Donald Bray
*Attorney, Agent, or Firm*—Kolisch, Hartwell, Dickinson, McCormack & Heuser

[57] ABSTRACT

A cutter head in a chipper that includes a rotatable hub member, and multiple knife assemblies distributed circumferentially about the rotation axis of the hub member. Each knife assembly includes a base member or holder which has multiple knives detachably clamped thereon. A base member is secured to the hub member through a groove provided in one of the members and a flange which is part of the outer member, with the flange seating within the groove.

10 Claims, 2 Drawing Sheets

KNIFE SUPPORTING STRUCTURE

CROSS-REFERENCE TO RELATED APPLICATION

This application is a continuation of U.S. patent application Ser. No. 08/904,968, filed Jul. 30, 1997.

BACKGROUND AND SUMMARY OF THE INVENTION

This invention relates to wood-working machines, and more particularly to what is referred to herein as a chipper which is operable to produce chips from a workpiece such as a log processed by the chipper.

Describing a form of chipper which is presently known today, such conventionally includes a power-rotated head which is disposed to one side of a support for an elongate workpiece, such as a log. The head supports one or more knife assemblies distributed about the rotation axis of the head, with these assemblies including knives operating to chip off wood material on a log with relative longitudinal movement of a log across the end of the head. In a chipper as just described, the knife structures on the head move in sweeps across the side of the log to produce the chipping action.

Chippers as known in the art of the above general description are described with particularity in prior issued patents U.S. 5,271,442 and U.S. 5,511,597.

In a known form of chipper, a hub member is provided which is rotated under power about an axis for the hub member. A knife assembly adjacent the periphery of the hub member is mounted in a suitably fixed position on the hub member so as to move in a circular sweep with rotation of the hub member. The knife assembly includes what is referred to herein as a holder or base member, and typically such holder is secured in place as with fasteners securing a platform at the base of the holder to the periphery of the hub member.

Problems have arisen with respect to the mounting of a holder on the hub member as above described. Obviously during operation of the chipper, considerable forces are impacted against the holder as the knife or knives that the holder carries encounters the wood material, knots or other matter being cut with operation of the chipper. The holder or base member must be mounted, therefore, in a fashion suitably resisting these forces and a tendency for the holder to be ripped or loosened from its mounting. The problems are particularly pronounced where space is limited, with the construction of the cutter head being such that little space is provided for accessing and securing a sufficient number of screws or fasteners for the proper securement of the holder in place.

A general object of this invention is to provide an improved construction for the securement of a holder or base member in a knife assembly to the periphery of a power-rotated hub member as is present in a power-operated chipper.

Another object is to provide an improved construction for fastening a holder to a hub member in a chipper which is easily accessed when necessary to remove the holder from its mounted position.

A further object is to provide such a construction which accurately positions the base or holder in a precise position on the hub member.

A specific object of the invention is to provide a construction for mounting a base member on a hub member which features an elongate groove indented into one of these members and an elongate flange which is an integral part of the other member which is buried within and received by the groove with the base member secured.

In a particular and preferred embodiment of the invention, an elongate gib is provided which generally parallels the flange described. This gib is shifted lengthwise to provide a camming action firmly securing the flange in its proper seated position.

BRIEF DESCRIPTION OF THE DRAWINGS

These and other objects and advantages are attained by the invention, which is described herein below in conjunction with the accompanying drawings, wherein.

DETAILED DESCRIPTION OF THE PREFERRED EMBODIMENT

Figure 4:
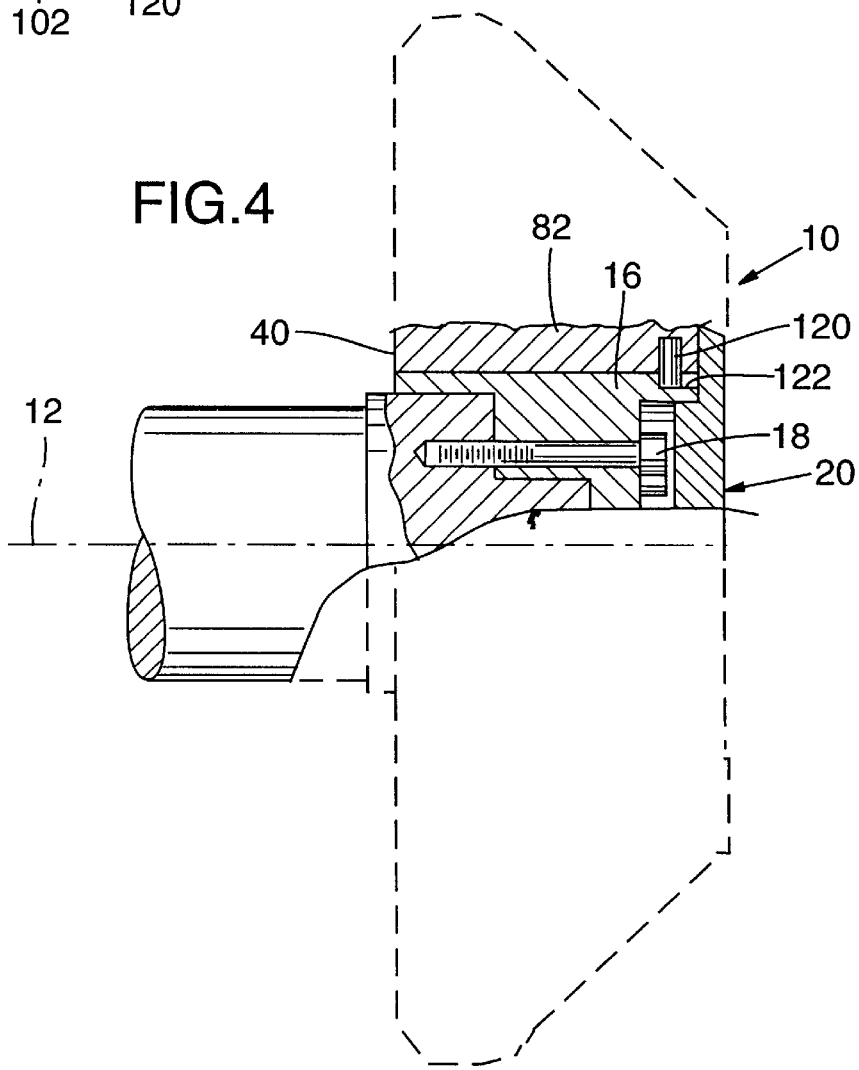
FIG. 4 is a side elevation, partially broken away along the line 4—4 in FIG. 1.

Referring now to the drawings, indicated generally at 10 is a power-rotated cutter head such as may be provided in a chipper used in the production of chips from a workpiece such as a log moved across the end of the cutter head. The cutter head is rotated under power with operation of the chipper, with the cutter head rotating about the axis indicated at 12. The cutter head includes what is referred to herein as a hub member 16 which is secured in place in the cutter head with fasteners 18 with the hub member rotating about axis 12. Distributing circumferentially about this hub member are multiple knife assemblies 22. A face plate assembly 20 (see FIG. 4) secured in a suitable manner to the front of the head covers the ends of fasteners 18 in the fully assembled cutter head.

Figure 1:
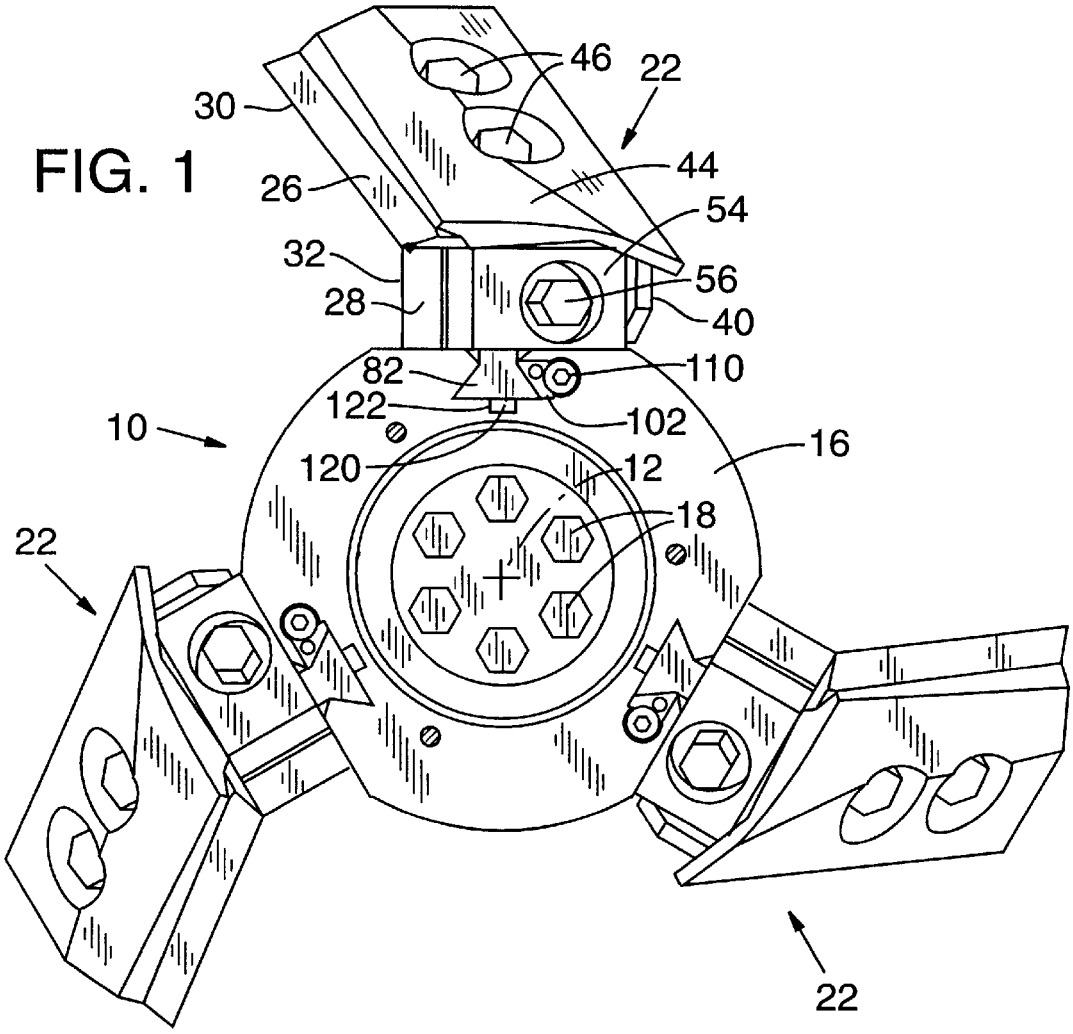
FIG. 1 is a perspective view of a cutter head.

Each knife assembly (refer to FIG. 1) mounts a pair of knives 26, 28 with cutting edges 30, 32 of these knives exposed in an operative position for producing cutting. With operation of a chipper and rotation of the cutter head, these knives move in circular sweeps about axis 12.

The knives in a knife assembly are detachably mounted in operative position on what is referred to herein as a knife holder or base member 40. The mounting for knife 26 includes an outer clamp 44 and fasteners 46 which when tightened draws the clamp 44 downwardly against the knife. Not shown, as not pertinent to an understanding of this invention, is a support for the under side of the knife, with the knife being sandwiched between this support and clamp 44. The assembly of clamp, knife and support are secured by fasteners 46 to a flat mounting surface 48 in the holder, with fasteners 46 received within bores 50 shown in the holder.

A similar mounting is provided for knife 28. A clamp 54 and fastener 56 together with an underlying support are provided for the securement of a knife against a flat mounting surface 58 in the holder. The fastener is received within bore 60 provided in the holder.

Mounting surfaces 48, 58 have proper orientation in the holder whereby the knives 26, 28 are held in proper position to produce the cutting action desired.

With knife 26 mounted in place and in operative position, its cutting edge 30 is exposed and lies beyond edge 66 of mounting surface 48 (refer to FIG. 3), and the cutting edge parallels edge 66 of surface 48. Edge 66 (and also cutting edge 30 of the knife) inclines upwardly progressing rearwardly in the holder. Viewing the holder in plan, these edges also are inclined at an angle relative to axis 12 of the head. Because of this relationship, the cutting edge, at least in part, extends in an axial direction, with a slicing action produced as the edge cuts through the wood.

Knife 26, as well as knife 28, may be double-edged knives, with a knife being removable from its mounting and then turned on its end and remounted to replace a worn cutting edge with the other of the two cutting edges in the knife. The two cutting edges parallel each other in the knife, and extend along opposite side margins.

Figure 3:
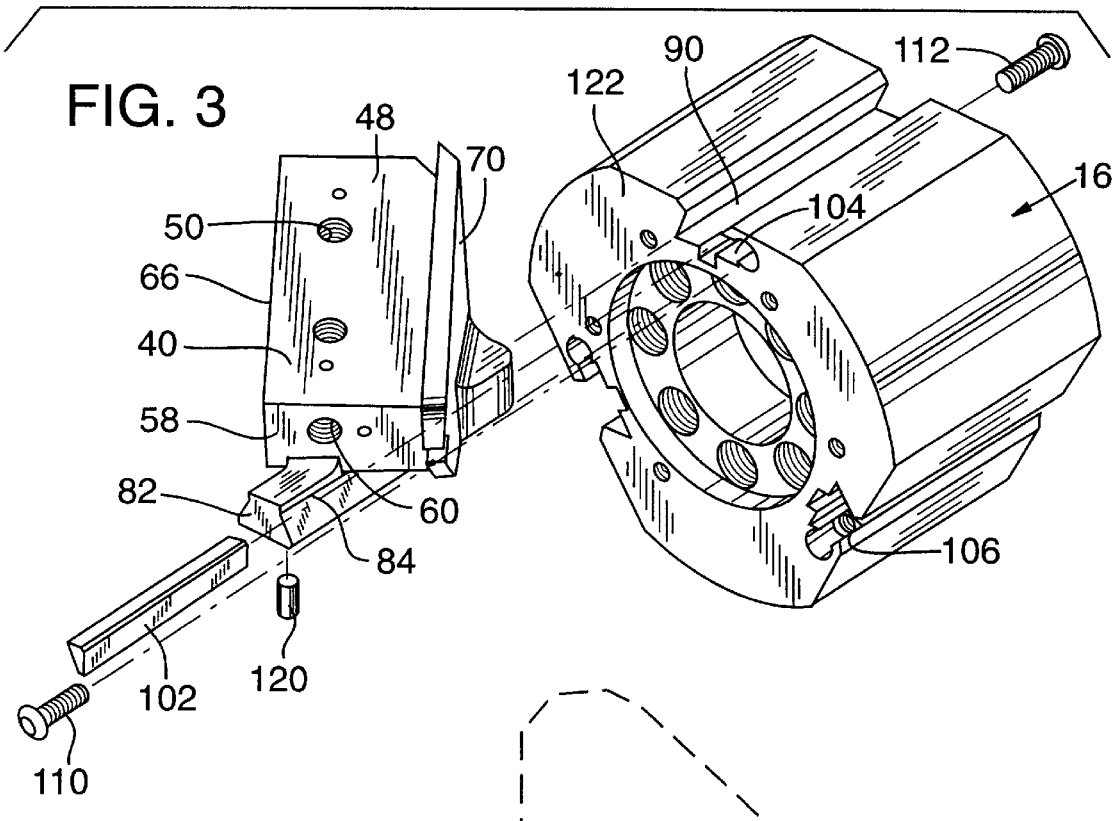
FIG. 3 is an exploded view, showing important components of the cutter head.

Considering now with more particularity the construction of the holder or base member in the cutter head, and referring to FIG. 3, mounting surface 48, mounting surface 58, and wall 70 are all joined to form a unitary structure. This structure is disposed above and joined to an elongate flange 82.

Flange 82 has a dove-tail cross-section (refer to FIG. 2), with the flange at its base having a greater width than in a region 84 spaced upwardly from the flange base, this region being referred to herein as a throat region.

Hub member 16, and referring to FIG. 3, is provided with an elongate groove 90 for each knife holder or base member supported on the hub member. This groove extends axially and parallels rotation axis 12. The groove in general outline matches the cross-sectional outline of flange 82, which means that it has a cross-section of approximately dove-tail configuration, with a base of greater width than the width of entry region 94 at the top of the groove.

By reason of the construction described, a holder may be mounted in place on the hub member by inserting an end of its flange 82 into an end of groove 90, and then shifting the holder to shift its flange lengthwise to place the flange in a fully seated or buried position within the groove. As so positioned, entry region 94 of reduced width is effective to capture the flange and inhibit radial outward displacement of the flange with rotation of the hub member and holder about axis 12.

An elongate gib 102 which tapers along its length is employed to finally secure a holder in its seated position. Further explaining, it will be noted that groove 90 includes along one side thereof, a channel 104 which parallels axis 12 and is open along its side to the remainder of the groove. With flange 82 in its proper position within the groove 90, gib 102 may be fitted into channel 104 and advanced along its length to firmly wedge against the flange and tightly secure in place. Channel 104 at its opposite extremities is provided with threaded regions 106. These receive screws such as those shown at 110, 112, which may be screwed into the threaded regions 106 to have heads of the screws come up against ends of the gib with the gib as a consequence then becoming locked into place.

Figure 2:
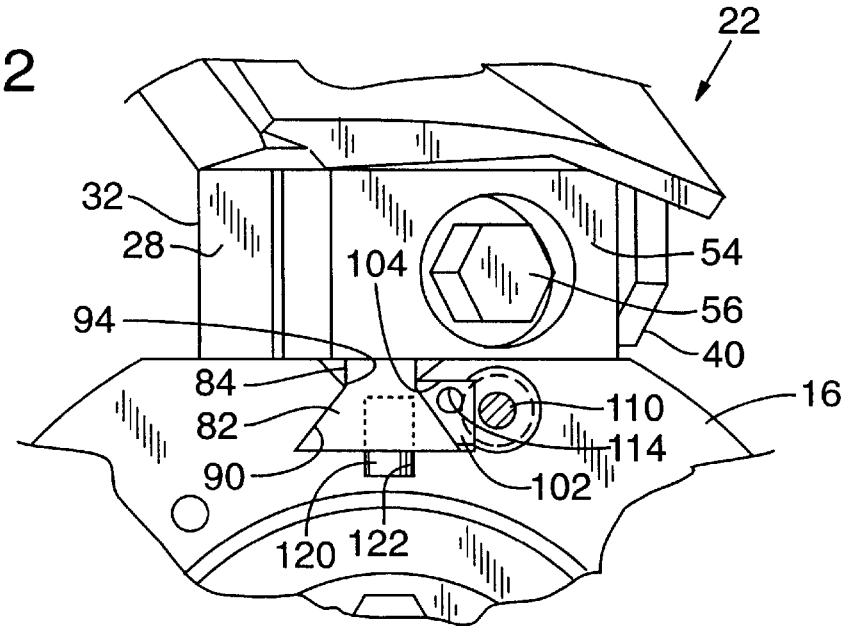
FIG. 2 is an enlargement of a portion of FIG. 1.

As best seen in FIG. 2, the end of gib 102 may be provided with a small threaded bore 114 adapted to receive a pull screw which may be inserted into the bore to permit a pulling force to be applied to the gib should such be needed when removing the gib.

Precise positioning of a holder or base member is obtained by providing a limiting pin 120 (see FIGS. 3 and 4) which is mounted in fixed position at one end of flange 82 and protrudes below the base of the flange. A positioning slot 122 extends inwardly from one end of groove 90 which snugly receives the limiting pin when such is advanced there into. The end of the positioning slot is defined by a wall, and proper positioning or indexing of the holder results when pin 120 comes up against this wall.

It should be obvious from the construction described, that the holder or base member is firmly held in position in a manner which well withstands the shocks and strusses to which the holder is subjected when the cutter head is used. This is without the requirement of screws or other fasteners cooperating with a platform-type base suitably bored to receive the screws, this type of construction typifying the prior art and having the disadvantages of presenting problems of access to the screws and requiring more space then is readily available with certain types of hub constructions. It should further be obvious that a holder is readily removed when necessary by first removing screws 110, 112, and then displacing gib 102, as by tapping it free with a tool. With the gib removed, it is an easy manner to remove a holder by shifting such in an axial direction to unseat its flange from groove 90.

While a particular embodiment of the invention has been described, it should be obvious that modifications and variations are possible with this disclosure having the purpose of explaining only a preferred embodiment of the invention.

It is claimed and desired to secure by Letters Patent:

1. A cutter head for a chipper, the cutter head being power-driven about a rotation axis, the cutter head comprising:

a hub member rotatable about said axis, a knife assembly mounted on said hub member disposed radially outwardly of said axis, the knife assembly including a base member disposed adjacent said hub member and a knife for cutting chips detachably mounted on said base member located radially outwardly of said hub member, and a mounting for said base member securing the base member in fixed position adjacent said hub member, said mounting including a groove indented into one of said members and an elongate flange joined to the other of said members and connected with said groove, said mounting further including an axially acting taperlock mechanism.

2. The cutter head of claim 1, wherein the axially acting taperlock mechanism includes an elongate gib which is shifted in the direction of its flange to tighten said flange in said groove.

3. The cutter head of claim 1, wherein the flange has a dove-tail cross-section inhibiting radially displacement of the flange.

4. A cutter head for a chipper, the cutter head being power-driven about a rotation axis, the cutter head comprising:

a hub member rotatable about said axis and having a face end extending generally radially outward from said axis, a knife assembly mounted on said hub member disposed radially outwardly of said axis, the knife assembly including a base member disposed adjacent said hub member and a knife for cutting chips detachably mounted on said base member with the knife located radially outwardly from said hub member, and a mounting system securing the base member in a fixed position adjacent the hub member, the mounting system including a fastener structure adjustable in an axial direction to produce tightening, the fastener structure being operable from the face end of the hub member.

5. The cutter head of claim 4, wherein the mounting system further includes an elongate groove indented into one of said members extending in an axialdirection and an elongate flange joined to the other member extending in an axial direction and received within said groove.

6. The cutter head of claim 5, wherein the flange has a dove-tail cross-section inhibiting radially outward displacement of the flange.

7. The cutter head of claim 5, wherein said groove includes a channel extending adjacent said flange, and wherein the fastener structure includes an elongate gib mounted within and extending along said channel located to one side of said flange with the gib shifted in the direction of its length to tighten said flange in said groove.

8. A cutter head for a chipper which comprises:

a rotatable power-driven hub member rotatable about an axis, multiple knife assemblies distributed circumferentially about said axis mounted on said hub member, each knife assembly including a base member disposed adjacent said hub member and a knife for cutting chips detachably mounted on said base member disposed radially outwardly from said hub member, and the knife including a cutting edge extending at least in part in an axial direction along said hub member, a mounting for said base member securing the base member in fixed position on said hub member, said mounting including a groove indented into one of said members extending in an axial direction, an elongate, axially extending flange joined to the other member buried in said groove, and an elongate gib extending alongside the flange and shifted in the direction of the length of the flange to tighten the flange in the groove.

9. The cutter head of claim 7, wherein said groove is indented into the hub member, and said flange is joined to the base member and forms the bottom of the base member.

10. The cutter head of claim 7, wherein said groove includes an elongate channel extending along a side thereof, and said gib fits within said channel and has a side thereof bearing against said flange.

* * * * *